US007137318B2

(12) United States Patent
Falzone

(10) Patent No.: US 7,137,318 B2
(45) Date of Patent: Nov. 21, 2006

(54) RATCHET-BASED, TORQUED-ENHANCED FASTENER TOOL

(76) Inventor: Loren P. Falzone, 333 Mountain Rd., Basking Ridge, NJ (US) 07920

( * ) Notice: Subject to any disclaimer, the term of this patent is extended or adjusted under 35 U.S.C. 154(b) by 19 days.

(21) Appl. No.: 10/997,314

(22) Filed: Nov. 24, 2004

(65) Prior Publication Data

US 2006/0107798 A1 May 25, 2006

(51) Int. Cl.
*B25B 17/02* (2006.01)
*B25B 13/46* (2006.01)

(52) U.S. Cl. ..... 81/57.3; 81/57.39

(58) Field of Classification Search ..... 81/57.3, 81/57.36, 57.39, 58.1
See application file for complete search history.

(56) References Cited

U.S. PATENT DOCUMENTS 1,970,721 A * 8/1934 Walton ..... 81/61
3,519,046 A * 7/1970 Pierce ..... 81/57.29
4,050,155 A * 9/1977 Pitocchi ..... 30/400
4,060,137 A 11/1977 Bickford et al.
4,063,475 A 12/1977 Perkins
4,249,617 A * 2/1981 Cox, Jr. ..... 173/170
4,274,310 A 6/1981 Michand
4,524,650 A * 6/1985 Marks ..... 81/57.39
4,739,838 A * 4/1988 Marks ..... 173/170
5,363,726 A * 11/1994 Smith ..... 81/57.29
6,343,530 B1 * 2/2002 Huang ..... 81/57.39
6,722,232 B1 * 4/2004 Day ..... 81/57.28
6,742,417 B1 * 6/2004 Ha ..... 81/57.36

* cited by examiner

*Primary Examiner*—David B. Thomas
(74) *Attorney, Agent, or Firm*—Kenneth P. Glynn, Esq.

(57) ABSTRACT

A ratchet-based, torque-enhanced fastener tool for tightening and loosening nuts, bolts, lug nuts and other fasteners includes a main housing and a handle attached to the main housing. A trigger is movably connected so that it can be moved in a reciprocal manner. A drive mechanism in the main housing is connected to the handle such that reciprocal movement of the handle moves the drive mechanism. A ratchet gear is functionally connected to the drive mechanism so as to rotate when the drive mechanism is moved. A drive gear is connected to the ratchet gear so as to rotate when the ratchet gear is so rotated. A socket wrench driver is connected to the drive gear so as to rotate simultaneously with the drive gear. By this arrangement, a user may attach a nut socket to the socket wrench driver, hold the handle and squeeze and release the trigger repeatedly to rotate the nut socket to drive a nut or other fastener.

11 Claims, 5 Drawing Sheets

RATCHET-BASED, TORQUED-ENHANCED FASTENER TOOL

BACKGROUND OF THE INVENTION

1. Field of the Invention

The present invention relates to hand tools, and, more particularly to hand held, hand driven tools for fastening and removing fasteners such as nuts and bolts. The present invention tools convert reciprocal hand motion to rotary motion for fastening and removing the fasteners single-handedly. In some embodiments, the tools include supports and second nut attachment capabilities to provide tool stability. This is especially useful for working with wheel lug nuts, wherein the tool is secured from its own undesired rotation by being affixed both to the nut that is being worked on and a second nut that acts as an anchor.

2. Information Disclosure Statement

The following prior art is representative of the state of the art in the field of fastener tools:

U.S. Pat. No. 4,060,137 to John H. Bickford et al. describes a torque wrench that is presented having bidirectional operating capability, accurate readout, and preset or load selection capability. The input drives a pair of ring gears, one of which is connected to the output of the wrench and the other of which is part of a reaction arm system which interacts with the readout and preset features.

U.S. Pat. No. 4,063,475 to Robert L. Perkins describes a lug nut tool for removing lug nuts from vehicle wheels. The tool includes a casing or body which carries a drive shaft which drives a shaft carrying a socket through a gear transmission. The gear transmission has an uneven number of gears and serves to increase or multiply the torque supplied at the drive shaft. Another spindle shaft is also rotatably mounted in the casing and carries a socket for engaging an adjacent lug nut to secure and stabilize the tool during use. The device can be driven by a manual wrench or other drive such as a power tool or impact tool.

U.S. Pat. No. 4,274,310 to Robert F. Michand discloses a torque multiplication device for use in tightening or loosening a nut, lug, bolt head and the like, employing a planetary transmission of sun, planet and orbit gear means which multiplies the applied torque input to produce an output torque to facilitate and simplify such tightening or loosening. Brake means incorporated with the device prevents rotation of the orbit gear means. A modification of the invention discloses an extensible brake arm which has an anchoring socket for securement with another nut, lug, bolt head and the like to likewise prevent rotation of the orbit gear means. Another modification of the invention discloses two sets of sun, planet, and orbit gear means having one common, drive output to produce uniform and balanced drive output. Another modification of the invention discloses a ring-like brake arm having a plurality of anchoring sockets for locking securement with the lugs of a motor-vehicle wheel.

Notwithstanding the prior art, the present invention is neither taught nor rendered obvious thereby.

SUMMARY OF THE INVENTION

The present invention relates to a ratchet-based, torque-enhanced fastener tool for tightening and loosening nuts, bolts, lug nuts and other fasteners. The tool includes a main housing and a handle attached to and extending generally downwardly from the main housing. A trigger is connected to one of the main housing and the handle and is movably, e.g., hingedly, connected to it so that it can be pulled toward the handle and released in a reciprocal manner. A biasing means is functionally connected to the trigger and adapted to bias the trigger away from the handle. A drive mechanism is located within the main housing and is connected to the trigger such that reciprocal movement of the trigger moves the drive mechanism. A ratchet gear is functionally connected to the drive mechanism so as to rotate when the drive mechanism is moved. A drive gear is directly or indirectly functionally connected to the ratchet gear so as to rotate when the ratchet gear is so rotated. A socket wrench driver is connected to the drive gear so as to rotate simultaneously with the drive gear. By this arrangement, a user may attach a nut socket to the socket wrench driver, hold the handle and squeeze and release the trigger repeatedly to rotate the nut socket to drive a nut to which it may be attached. It may be used for any nut tightening or loosening effort, and is especially useful for lug nuts on motor vehicles, trailers, etc.

In some embodiments, the present invention ratchet-based, torque-enhanced fastener tool of claim trigger is hingedly connected to the main housing adjacent to the handle, and the biasing means is a spring located within the main housing. In other embodiments, the trigger may be slideably connected so as to move in and out, rather than on a pivot (hinge), and would be spring biased away from the handle.

In some present invention embodiments, the ratchet-based, torque-enhanced fastener tool ratchet gear is indirectly connected to the drive gear, with a connecting reduction gear therebetween. In other embodiments, the present invention ratchet-based, torque-enhanced fastener tool of claim ratchet gear is indirectly connected to the drive gear, with connecting bevel gears therebetween. In yet other embodiments, the ratchet gear is indirectly connected to the drive gear, with at least two connecting bevel gears and at least one reduction gear therebetween.

In some embodiments, the present invention ratchet-based, torque-enhanced fastener drive mechanism is a reciprocating rod connected to the trigger and connected to the ratchet gear so as to move the ratchet gear in one direction. However, as a practical matter, most embodiments would have a forward and a reverse capability, and thus, in some preferred embodiments, the fastener tool has one of the drive mechanism and the ratchet gear with a forward component and a reverse component and the tool includes a reversing switch connected to one of the drive mechanism and the ratchet gear. It has a first position and a second position, wherein the ratchet gear may be driven by the trigger in a clockwise direction when the switch is in the first position, and may be driven by the trigger in a counterclockwise direction when the switch is in the second position, one being a forward direction and the other being a reverse direction. For example, the ratchet gear has a forward clockwise gear and a reverse counterclockwise gear and the switch raises and lowers the drive mechanism so as to be functionally connected to one of the forward clockwise gear and the reverse counterclockwise gear when raised, and the other when lowered by the switch.

Generally, the biasing means is connected from the main housing to the trigger. In some embodiments, the drive mechanism and the biasing means may also be connected to one another.

In other embodiments, the present invention ratchet-based, torque-enhanced fastener tool for tightening and loosening lug nuts and other fasteners has all of the features set forth above, and also includes a support extending away from the main housing, the support having a dummy socket wrench driver adapted to receive a stabilizer lug nut socket. Thus, a user may attach a lug nut socket to the socket wrench driver and attach another lug nut socket to the dummy socket wrench driver, attach the lug nut socket to a first lug nut to be removed or fastened to a wheel, attach the stabilizer lug nut socket to a second lug nut on the wheel, repeatedly pull the trigger, and thereby rotate the first lug nut while the second lug nut stabilizes the tool and keeps the handle from rotating instead of the first lug nut. In some preferred embodiments, the dummy socket driver is slideably connected to the support and may be locked at selected positions by locking means, so that a user may adjust distance between the socket driver and the dummy socket driver to accommodate a plurality of wheels with differently spaced lug nuts. It is preferred that the dummy socket driver is slideably connected to the support with a locking means that is rotated for locking and unlocking the dummy driver on the support at various positions thereon.

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

The present invention relates to the field of single-handed hand tools used for reduced effort in loosening or tightening a rotatable mechanical fastener, such as a nut, bolt lug nut or the like. Minimal human effort applied to a compact, light-weight, mechanically secured torque multiplier transmits appropriate torque-to-speed ratio rotational energy to a standard socket wrench driver and socket attachment of choice. The gun-style design allows for hold-and-squeeze (point-and-shoot) operation. Renditions of the invention may include mechanically and/or hydraulically generated torque as well as reversible rotation.

Whereas the originating purpose of torque multiplying tools is the allowance of humans to conveniently rotate otherwise difficult or impossible to turn tightened threaded mechanical fasteners, prior art does not simultaneously provide for all of the following directly related conveniences typically required to common situations. These present invention advantages include the ability to loosen stuck vehicle wheel lug nuts, manual power, compact size, light weight, low cost, and single handed operation, with optional double handed operation always available for operators with low strength availability. Examples of the disadvantages of the prior art cited above include:

In the following U.S. patents: U.S. Pat. No. 4,274,310 requires 2 hands for loosening multiple components; U.S. Pat. No. 4,063,475 requires extra size, cost, room and effort for multiple fasteners; U.S. Pat. No. 4,060,137 requires external power (pneumatic). Unlike the prior art, the present invention exclusively and successfully addresses all aforementioned deficiencies of the prior art.

Figure 1:
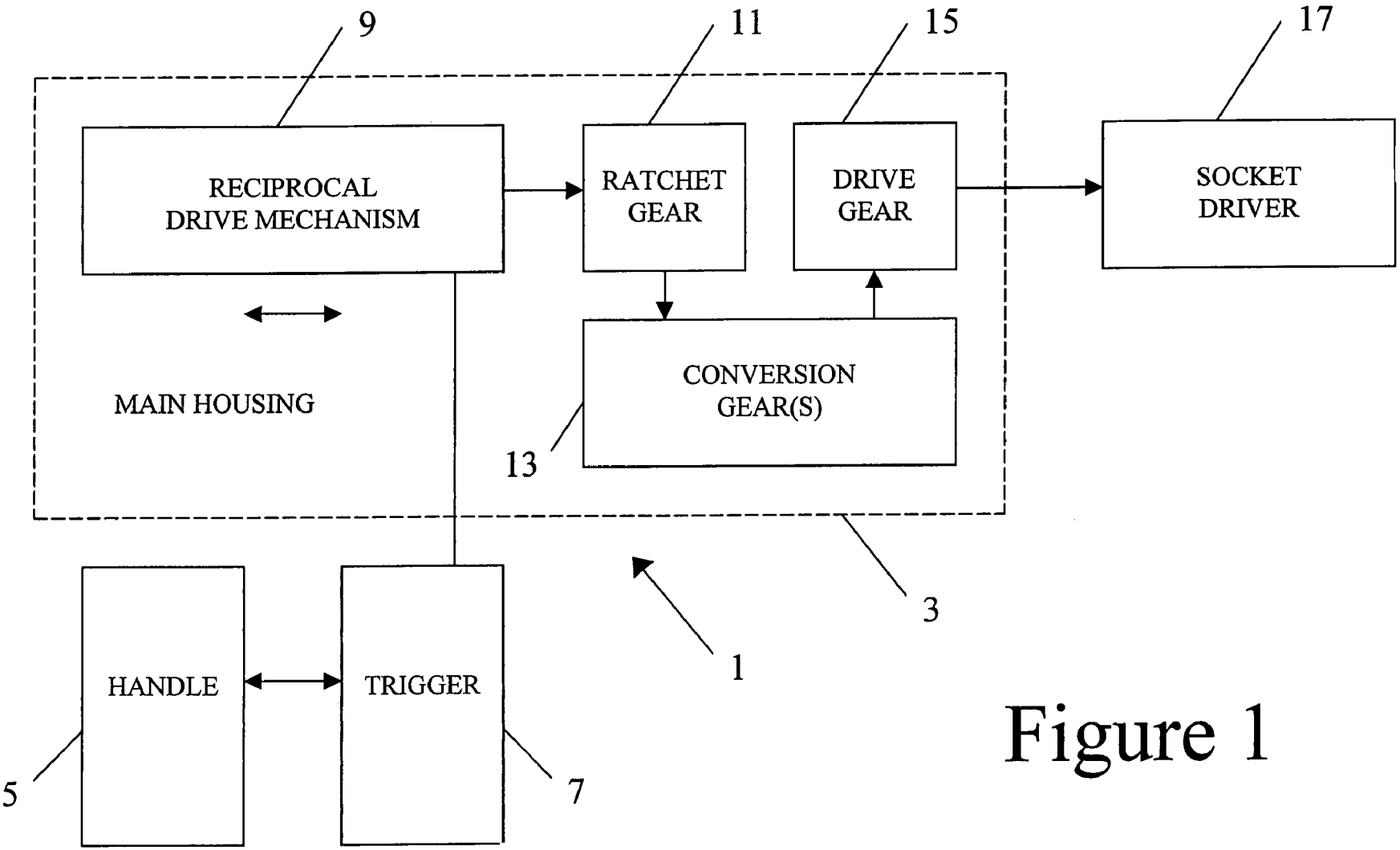
FIG. 1 illustrates a block diagram of a present invention ratchet-based, torque-enhanced fastener tool.

FIG. 1 shows a block diagram of a present invention ratchet-based, torque-enhanced fastener tool 1, with a main housing 3. This main housing 3 may be made of metal, high impact polymeric material, fiber such as carbon fiber, or combinations of these, or any other high strength materials that hand and power tools may be constructed. A handle 5 is connected to or integrally formed with the main housing 3, and a trigger 7 is connected to either the housing 3 or the handle 5, or both. The trigger 7 is connected so as to move in a reciprocal fashion to and from the handle 5. This movement could be linear to and from the handle or arcuated with a pivot point anywhere on the handle or even inside the main housing, as long as the trigger is functionally connected to drive mechanism 9 and is able to move the drive mechanism in an advance-retract motion, wherein the drive mechanism engages operational gears or equivalent to rotate the drive gear of the socket driver. The trigger 7 is always biased away from the handle 5 so that it returns to the "firing position" after each pull or squeeze. This bias may be created by a spring that is a separate piece, built into the handle 5 or trigger 7 or housing 3, or the trigger itself could be formed of living spring material, such as a springy plastic or a metal leaf spring. Thus, in this embodiment shown diagrammatically in FIG. 1, the reciprocal drive mechanism 9 is moved back and forth by pulling and releasing trigger 7. The drive mechanism 9 moves ratchet gear 11 in only one direction (hence "ratchet"), and this in turn rotates conversion gear(s) 13, and they then rotate drive gear 15. Drive gear 15 is connected to and rotates socket driver 17, to which sockets from standard socket wrench sets may be attached. The conversion gear(s) 13 could be bevel gears, reduction gears, linear gears or other connections that will impart the reciprocal movement of the drive gear to rotational movement to the drive gear 15. Components for reverse could be included, such as shift of dual direction ratchet gear having opposing tracks with only one or the other engageable at any time, moveable drive mechanism with forward and reverse ratchet strips, etc.

Figure 2:
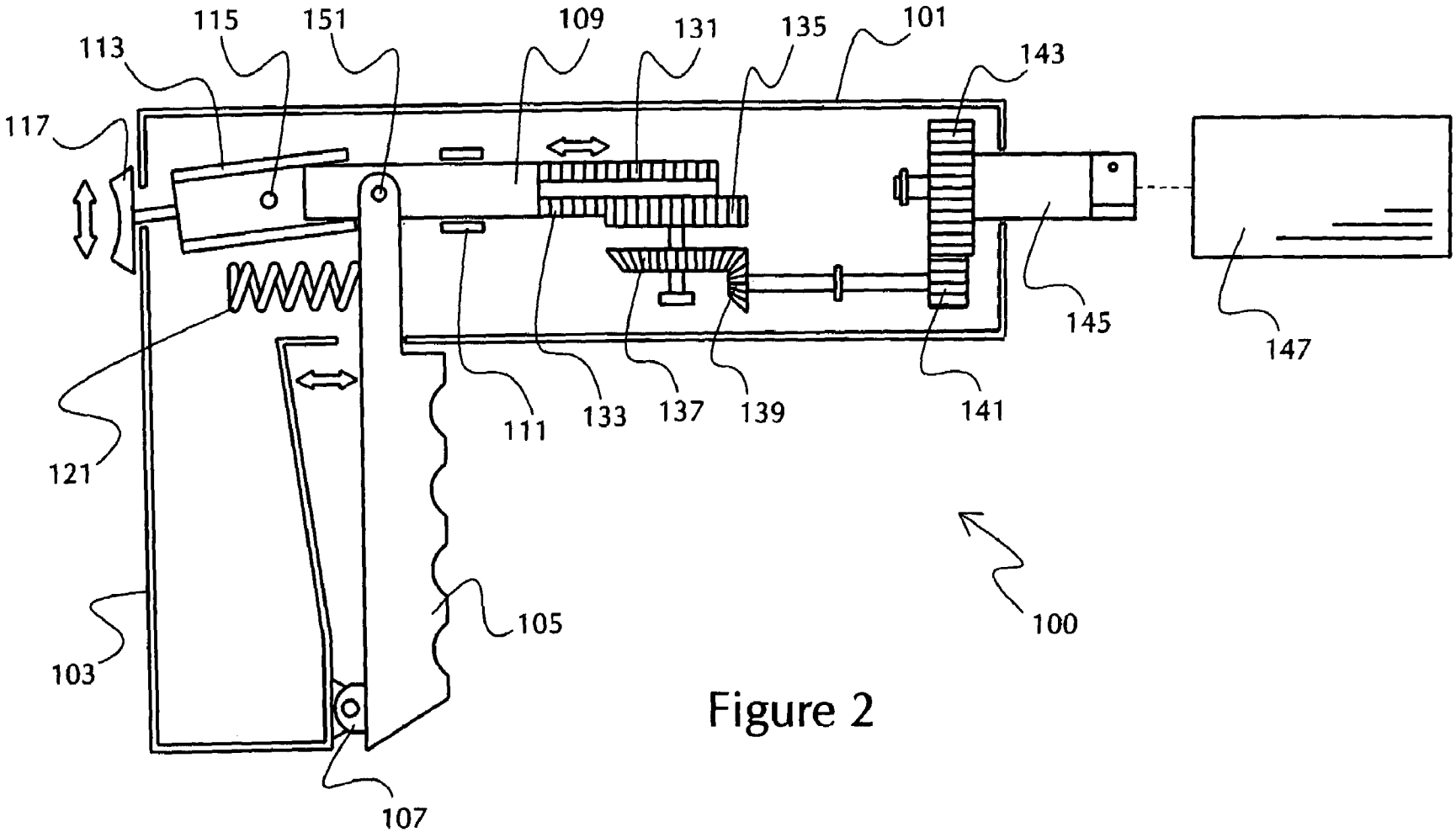
FIG. 2 shows a side view of one embodiment of a present invention ratchet-based, torque-enhanced fastener tool.

FIG. 2 shows a side view of one embodiment of a present invention ratchet-based, torque-enhanced fastener tool 100. It has a main housing 101, a handle 103, and a trigger 105. The trigger 105 is attached to handle 103 at its bottom, so as to rotate in an arc about pivot point 107. Trigger 105 is connected at its top by rivet 151 to reciprocal drive mechanism 109, which shifts laterally back and forth as trigger 105 is pulled and released. Spring 121, located inside housing 101 as shown, biases the trigger 105 away from handle 103.

Channel 113 acts as a slide guide for drive mechanism 109 when it moves back and forth. Channel 113 has a pivot point 115 and is connected to button 117, which acts as a forward/reverse button. When button 117 is pushed down, channel 113 rotates drive mechanism 109 upwardly slightly so that ratchet strip 133 engages connection gear 135 and drives the gear 135 forward (e.g., clockwise), as shown. If button 117 is pushed up, the front end of drive mechanism 109 is tilted downwardly slightly, and ratchet strip 131 will engage gear 135 to operate it in reverse (counterclockwise). Gear 135 will rotate bevel gear 137, which rotates bevel gear 139. This drives reduction gear 141 and that in turn drives drive gear 143 and socket driver 145. Socket driver 145 may be connected to a socket such as standard wrench socket 147 to open and close nuts, bolts, hex caps, lug nuts and other similar fasteners.

Figure 3:
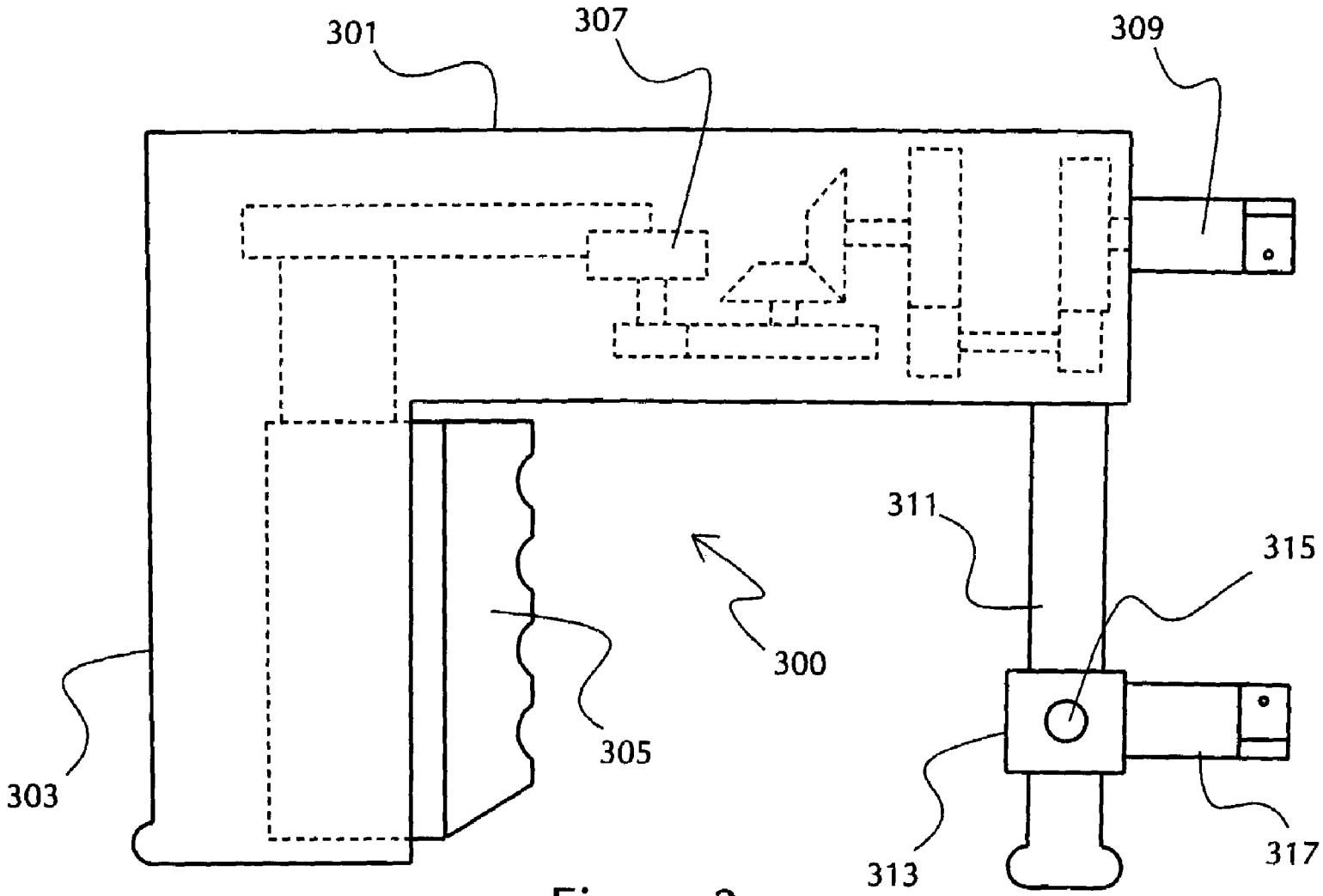
FIG. 3 shows another present invention ratchet-based, torque-enhanced fastener tool.

FIG. 3 shows another present invention ratchet-based, torque-enhanced fastener tool 300. It includes a main housing 301, a handle 303, and a trigger 305. The trigger 305 is attached to handle 303 so as to move laterally to and from the handle 303. Trigger 305 is connected at its to a reciprocal drive mechanism, which shifts laterally back and forth as trigger 305 is pulled and released. A spring (not shown) is located inside handle 303 that biases the trigger 305 away from handle 303.

Gears in FIG. 3 are shown collectively as gears 307 and may have any workable connections, ratios, etc. and could be the same as shown in FIG. 2 above, or otherwise. The gears 307 ultimately drive a drive gear and socket driver 309. Socket driver 309 may be connected to a socket such as standard wrench socket to tighten and loosen nuts, bolts, hex caps, hex driven elements, lug nuts and other similar fasteners.

In FIG. 3, there is a support 311 extending downwardly from main housing 301 that has a sliding ring 313, with screw lock 315, that may be moved up and down support 311 to match spacing between two lug nuts. Dummy driver 317 extends outwardly from ring 131 and is in the same vertical plane as socket driver 309. Sockets are attached to both of these and are in turn attached to lug nuts. The dummy driver socket will simply hold at its lug nut and act as a stabilizer to prevent undesired rotation of the tool 300. The trigger 305 can be pulled and driver 309 will rotate to drive the lug to which its socket is connected.

Figure 4:
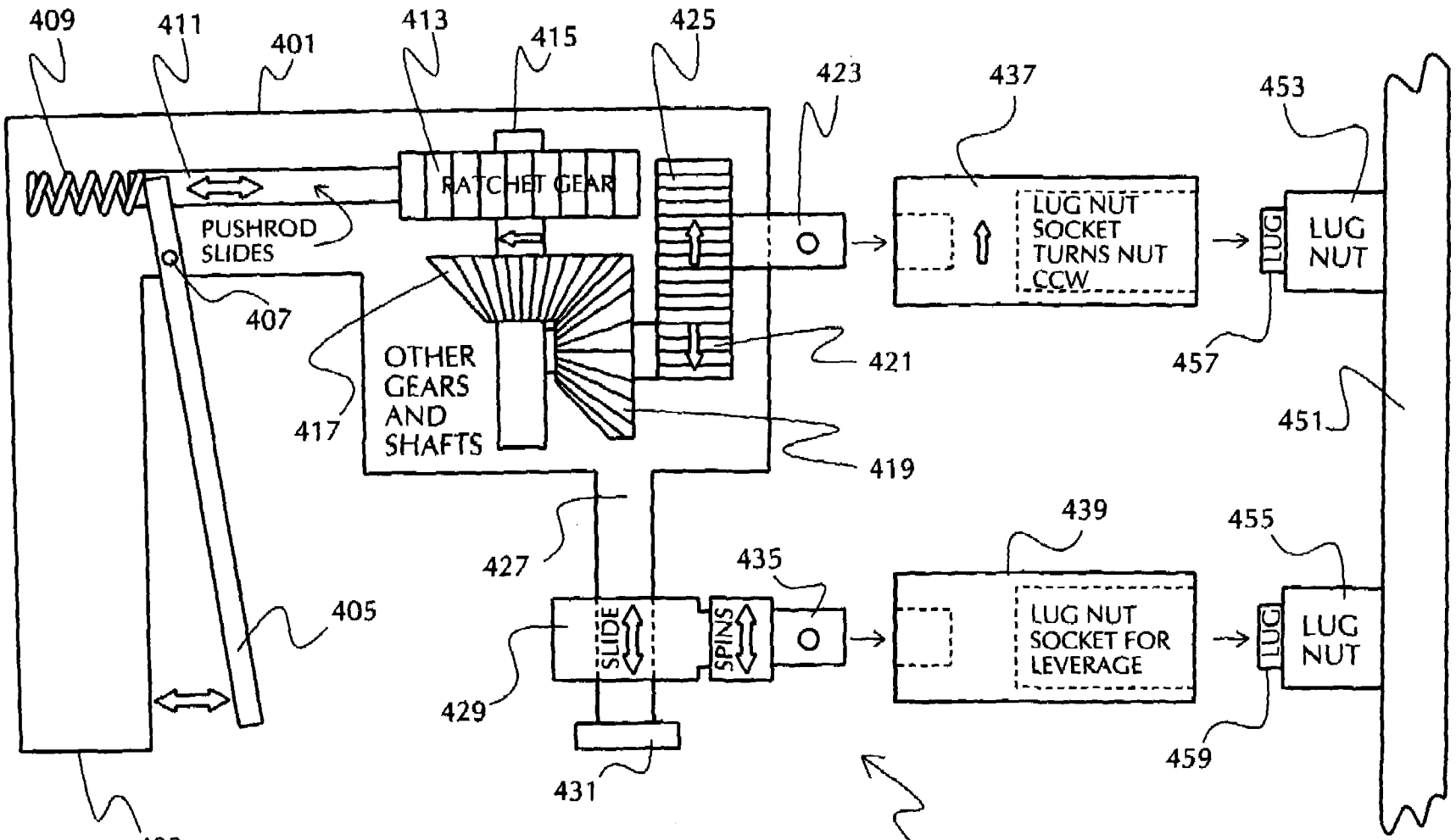
FIG. 4 illustrates another preferred embodiment of the present invention being used to fasten a lug nut onto a wheel; and, FIG. 5 illustrates an embodiment of the invention that uses hydraulic drive mechanism.

FIG. 4 illustrates another preferred embodiment of the present invention tool 400, being used to fasten a lug nut 453 to its lug 457 on a wheel 451. It has a main housing 401, a handle 403, and a trigger 405. The trigger 405 is attached to housing 401 at its top, so as to rotate in an arc below pivot point 407. Trigger 405 is connected at its top to reciprocal drive mechanism 411, which shifts laterally back and forth as trigger 405 is pulled and released. Spring 409, located inside housing 401 as shown, biases the trigger 405 away from handle 403.

When trigger 405 reciprocally moves drive mechanism 411, it engages ratchet gear 413 and drives it in one direction. Gear 413 on shaft 4155 will rotate bevel gear 417, which rotates bevel gear 419. This drives reduction gear 421 and that in turn drives drive gear 425 and Socket driver 423. Socket driver 423 may be connected to a socket such as standard wrench socket 437 to open and close lug nut 453 and other similar fasteners. Support 427 has ring 429 with dummy driver 435 which attaches to socket 439. Socket 439 in turn is affixed to lug nut 455 on lug 459 for stability of the tool 400 during use.

Figure 5:
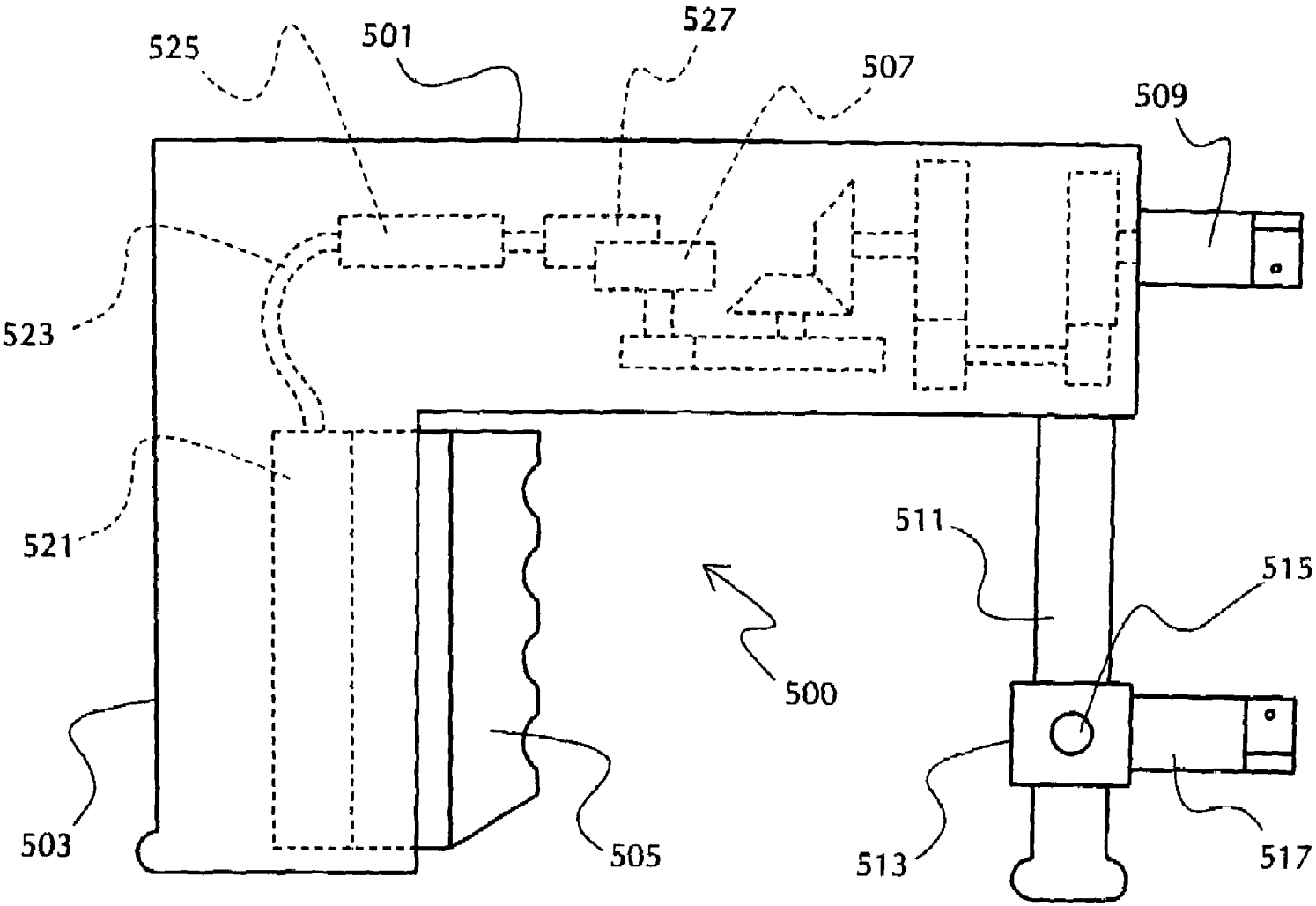

FIG. 5 illustrates an embodiment of the invention that uses hydraulic drive mechanism. It has a main housing 501, a handle 503, and a trigger 505. The trigger 505 is attached to handle 503, so as to slide along an imaginary horizontal line. When pulled, trigger 505 moves hydraulic fluid from flexible container 521, through tube 523 and into cylinder 525 to drive a piston and its extended drive mechanism 527. From this point, gears or drives 507 are connected to the driver 509 for connection to a socket to be used as described above, for example. Support 511 has a sliding loop 513 with a lock 515 with dummy driver 517 which attaches to socket, which in turn may be affixed to lug nut for stability of the tool during use.

Obviously, numerous modifications and variations of the present invention are possible in light of the above teachings. It is therefore understood that within the scope of the appended claims, the invention may be practiced otherwise than as specifically described herein.

What is claimed is:

1. A ratchet-based, torque-enhanced fastener tool for tightening and loosening lug nuts and other fasteners, which comprises:

a) a main housing having an imaginary horizontal axis;

b) a handle attached to and extending downwardly from said main housing and away from said imaginary horizontal axis;

c) a trigger connected to one of said main housing and said handle and being hingedly connected thereto as to be pulled toward said handle and released in a reciprocal manner;

d) biasing means functionally connected to said trigger and adapted to bias said trigger away from said handle;

e) a drive mechanism within said main housing and connected to said trigger such that reciprocal movement of said handle moves said drive mechanism;

f) a ratchet gear functionally connected to said drive mechanism so as to rotate when said drive mechanism is moved;

g) a drive gear directly or indirectly functionally connected to said ratchet gear so as to rotate when said ratchet gear is so rotated; and, h) a socket wrench driver connected to said drive gear so as to axially rotate simultaneously with said drive gear;

i) a support connected to and extending away from said main housing, said support having a dummy socket wrench driver adapted to receive a stabilizer lug nut socket;

wherein a user may attach a first lug nut socket to said socket wrench driver and attach a second lug nut socket to said dummy socket wrench driver, and with the use of a single band, attach said first lug nut socket to a first lug nut to be removed or fastened to a wheel, attach said stabilizer-connected second lug nut socket to a second lug nut on said wheel, repeatedly pull said trigger, and thereby rotate said first lug nut, thereby effecting rotational stabilization, axial stabilization and first lug nut movement single handedly.

2. The ratchet-based, torque-enhanced fastener tool of claim 1, wherein said dummy socket driver is slideably connected to said support and may be locked at selected positions by locking means, so that a user may adjust distance between said socket driver and said dummy socket driver to accommodate a plurality of different wheels with differently spaced lug nuts.

3. The ratchet-based, torque-enhanced fastener tool of claim 2, wherein said dummy socket driver is slideably connected to said support with a locking means that is rotated for locking and unlocking said dummy driver on said support at various positions thereon.

4. The ratchet-based, torque-enhanced fastener tool of claim 1 wherein said trigger is hingedly connected to said main housing adjacent to said handle, and said biasing means is a spring located within said main housing.

5. The ratchet-based, torque-enhanced fastener tool of claim 1 wherein said ratchet gear is indirectly connected to said drive gear, with a connecting reduction gear therebetween.

6. The ratchet-based, torque-enhanced fastener tool of claim 1 wherein said ratchet gear is indirectly connected to said drive gear, with connecting level gears therebetween.

7. The ratchet-based, torque-enhanced fastener tool of claim 1 wherein said ratchet gear is indirectly connected to said drive gear, with at least two connecting level gears and at least one reduction gear therebetween.

8. The ratchet-based, torque-enhanced fastener tool of claim 1 wherein said drive mechanism is a reciprocating rod connected to said trigger and connected to said ratchet gear so as to move said ratchet gear in one direction.

9. The ratchet-based, torque-enhanced fastener tool of claim 1 wherein one of said drive mechanism and said ratchet gear has a forward component and a reverse component and said tool includes a reversing switch connected to one of said drive mechanism and said ratchet gear, and having a first position and a second position, wherein said ratchet gear may be driven by said trigger in a clockwise direction when said switch is in said first position, and may be driven by said trigger in a counterclockwise direction when said switch is in said second position.

10. The ratchet-based, torque-enhanced fastener tool of claim 9 wherein said ratchet gear has a forward clockwise gear and a reverse counterclockwise gear and said switch raises and lowers said drive mechanism so as to be functionally connected to one of said forward clockwise gear and said reverse counterclockwise gear when raised, and the other when lowered by said switch.

11. The ratchet-based, torque-enhanced fastener tool of claim 1 wherein said drive mechanism and said biasing means are connected to one another.

* * * * *